US005603491A

United States Patent [19]

Murrell

[11] Patent Number: 5,603,491

[45] Date of Patent: Feb. 18, 1997

[54] PORTABLE WORKSTAND MODULE

[76] Inventor: Anthony S. Murrell, P.O. Box 166, Elwood, Ind. 46036

[21] Appl. No.: 491,473

[22] Filed: Jun. 16, 1995

[51] Int. Cl.[6] ..... B25B 1/10

[52] U.S. Cl. ..... 269/15; 269/16; 269/17; 269/152; 269/901

[58] Field of Search ..... 144/287, 286.1; 269/16, 15, 139, 901, 17, 152; 108/6

[56] References Cited

U.S. PATENT DOCUMENTS

| | | | |
|---|---|---|---|
| 1,556,882 | 10/1925 | Weaver | 269/16 |
| 2,825,477 | 3/1958 | Ross | 269/17 |
| 4,236,599 | 12/1980 | Luff et al. | 144/286.1 |
| 4,278,243 | 7/1981 | Alessia | 269/901 |
| 4,328,846 | 5/1982 | Hanson | 269/901 |
| 4,964,450 | 10/1990 | Hughes et al. | 144/287 |
| 5,004,029 | 4/1991 | Garner | 269/901 |
| 5,320,150 | 6/1994 | Everts et al. | 269/901 |

*Primary Examiner*—Robert C. Watson
*Attorney, Agent, or Firm*—Robert A. Spray

[57] ABSTRACT

Tubular frame pieces, with generally a welded construction, provide a sturdy support for mounting a heavy duty vise or other heavy-duty tool. Convenient changeability is provided from an erect working condition to a compact condition for transport or storage, even though such convenient changeability would not be expected for such heavy duty apparatus. A rear leg frame assembly and a front leg frame assembly are rotatably carried by transverse bars of a base frame. Temporary or partially-supported condition is provided for ease of erection, but a positive erection-holding feature is also provided. Extender bars are optionally provided for carrying ancillary features in addition to the mounting table for the vise. A base frame is provided with wheels, the wheels being movable to a floor-engaging position for ease of mobility, and a retracted position for maximum sturdiness.

4 Claims, 7 Drawing Sheets

PORTABLE WORKSTAND MODULE

I. Field and Background of the Invention

The present invention relates to a workstand, module for construction or maintenance workers who need the convenience and rigidity of a sturdy workstand to support heavy-duty tasks, e.g., the working on steel members, by tasks of forming, cutting, drilling, etc.

More particularly, the invention relates to a sturdy workstand which has the rigidity and strength of a permanent and stationary workbench which is quite sturdy for heavy duty use, yet nevertheless provides the advantage of easy movability.

Still more particularly, the present invention relates to and achieves a rugged and sturdy workbench but which has the quality of easy collapsibility for easy movability to a different job site.

II. PROBLEM INHERENT AS TO FORM DETAILS OF A WORKBENCH

Most workmen would like a workbench which is amply sturdy for heavy-duty projects, but all prior art heavy-duty workbenches known to the inventor have the disadvantages of either non-movability or rather difficult movability; and the qualities of rugged sturdiness seem generally opposite to the characteristic of easy movability from jobsite to jobsite.

More particularly, although sturdy ruggedness can be easily built into a workbench by bracing pieces, heavy and/or thick components, etc., many job occasions require movability of the workbench by motorized trucking equipment which is often not conveniently or economically available, not only making it desirable that the workbench be reasonably movable but desirably even provided with a characteristic of rather full but convenient collapsibility and re-assembly.

Another problem of the construction of workbenches is that their heaviness characteristic, which has been built into the workbench for strength, makes any movement of the workbench very difficult, even if the movement is of a short distance such as fully within the workshop itself.

Other and more particular difficulties are and surely have long been obvious to construction and/or maintenance workers and other users, due to the generally opposite and usually incompatible qualities of rugged strength yet easy movability.

III. SUMMARY OF THE INVENTIVE CONCEPTS

In carrying out the invention in a preferred embodiment, tubular frame pieces are provided to make a sturdy support for a mounting table component, such as a table for mounting a heavy duty vise or other heavy duty tool or tools. The unit provides convenient changeability from an erect working condition to a compact condition for transport or storage.

A rear leg frame assembly and a front leg frame assembly are rotatably carried by transverse bars of a base frame; and the provision is made for a temporary or partially-supported condition for ease of assembly, but with a positive erection-holding feature which is easily achieved after the temporary-erection condition is established.

Extender bars are optionally provided for use such as the carry of a large work table in addition to the presence of a mounting table for the vise. A base frame is provided with wheels; and the wheels are made to be movable to a floor-engaging position for ease of mobility, and a retracted position in which the base frame itself engages the floor for maximum sturdiness.

Most connections except the rotational ones of the leg-set assemblies are of a weld nature, further adding to the sturdiness and rigidity achieved by the work stand.

Further details are specified in the detailed description.

IV. PRIOR ART CAPABILITY AND MOTIVATIONS, AS HELPING TO SHOW PATENTABILITY HERE

Even in hindsight consideration of the present invention to determine its inventive and novel nature, it is not only conceded but emphasized that the prior art had many details usable in this invention, but only if the prior art had had the guidance of the present concepts of the present invention, details of both capability and motivation.

That is, it is emphasized that the prior art had/or knew several particulars which individually and accumulatively show the non-obviousness of this combination invention. E.g., a. The prior art has long had workbench facilities of many shapes, natures, and sizes;

b. The prior art knew the advantages of both sturdiness and mobility of workplace accessories;

c. The prior art has had foldable or collapsable apparatus of man: types having both a relatively flat or collapsed storage and/or transport nature and a relatively erect working nature, with varieties of fold-up mechanism details, as are exemplified by such diverse mechanisms and foldability features as may be found in baby cabs, folding lawn chairs, and innumerable other articles;

d. The ease of tooling for the present invention has surely given manufacturers ample incentive to have made modifications for commercial competitiveness in a competitive industry, if the concepts had been obvious;

e. The prior art has always had sufficient skill to make many types of tables and workbench features, more than ample skill to have achieved the present invention, but only if the concepts and their combination had been conceived;

f. Substantially all of the operational characteristics and advantages of details of the present invention, when considered separately from one another and when considered separately from the present invention's details and non-technical accomplishment of the details, are within the skill of persons of various arts, but only when considered away from the integrated and novel combination of concepts which by their cooperative combination achieves this advantageous invention;

g. The details of the present invention, when considered solely from the standpoint of construction, are exceedingly simple; and the matter of simplicity of construction has long been recognized as indicative of inventive creativity; and h. Similarly, and a long-recognized indication of inventiveness of a novel combination, is the realistic principle that a person of ordinary skill in the art, as illustrated with respect to the claimed combination as differing in the stated respects from the prior art both as to construction and concept, is presumed to be one who thinks along the line of conventional wisdom in the art and is not one who undertakes to innovate.

Accordingly, although the prior art has had capability and motivation, amply sufficient to presumably give incentive to the development of a workbench and tool table according to the present invention, the fact remains that this invention awaited the creativity and inventive discovery of the present inventor. In spite of ample motivation and capability shown by the many illustrations herein, the prior art did not suggest this invention.

V. PRIOR ART AS PARTICULAR INSTANCES OF FAILURE TO PROVIDE THIS NOVEL WORKBENCH

In view of the inherent difficulties which attend the laborious task of supporting heavy work tools, large work objects, accessory items, parts being repaired, or other objects, it is not difficult to realize that the prior art has not projected itself to the combination purpose and achievement of the present invention, even though object-holding is a widespread daily and practically universal task, and the table industry is quite commercial and competitive. Further, users surely include an uncountable multitude of persons, at least of sufficient experience, skill, etc., that the present invention would have been desired and attempted long ago, but only if its factors and combination-nature had been obvious.

The consideration of a nature of the present inventive concepts will be helped by a summarized consideration of the prior art; however, as workbenches are so well known and universally known and used, merely some reminders as to them as well-known prior art seem sufficient.

That is workbenches and other workstands have been known and used, and workplace accessories have been made both sturdy and mobile for many scores of years, and many have been made to have both characteristics.

As to the often-opposing features of both sturdiness and mobility, as characteristics or capability, nothing is here asserted to be novel; and, in contrast, the concepts of the present invention provide the building upon the principal nature and function of these features, rather than any modification of their function.

VI. SUMMARY OF THE PRIOR ART'S LACK OF SUGGESTIONS OF THE CONCEPTS OF THE INVENTION'S COMBINATION

In spite of all such factors of the prior art, the problem here solved awaited this inventor's consideration, ideas, and creativity. More particularly as to the novelty here of the invention as considered as a whole, the resume of the prior art uses and needs helps show its contrast to the present concepts, and emphasizes the advantages, novelty, and the inventive significance of the present concepts as are here shown, particularly as to utility and convenience of use as detailed herein, as to apparatus and a procedure.

Moreover, prior art articles known to this inventor, which could possibly be adapted for this duty, fail to show or suggest the details of the present concepts as a combination; and a realistic consideration of the prior art's differences from the present concepts of the overall combination may more aptly be described as teaching away from the present invention's concepts, in contrast to suggesting them, even as to a hindsight attempt to perceive suggestions from a backward look into the prior art, especially since the prior art has long had much motivation as to details of the present invention and to its provisions.

And the existence of such prior art knowledge and related articles embodying such various features is not only conceded, it is emphasized; for as to the novelty here of the combination, of the invention as considered as a whole, a contrast to the prior art helps also to remind both the great variety of he various prior art articles and needed attempts of improvement, and he advantages and the inventive significance of the present concepts. Thus, as shown herein as a contrast to all the prior art, the inventive significance of the present concepts as a combination is emphasized, and the nature of the concepts and their results can perhaps be easier seen as an invention.

Although varieties of prior art are conceded, and ample motivation is shown, and full capability in the prior art is conceded, no prior art shows or suggests details of the overall combination of the present invention, as is the proper and accepted way of considering the inventiveness nature of the concept.

That is, although the prior art may show an approach the overall invention, it is determinatively significant that none of the prior art shows the novel and advantageous concepts in combination, which provides the merits of this invention, even though certain details are shown separately from this accomplishment as a combination.

And the prior art's lack of an invention of an economical workbench apparatus achieving the convenience, effort-saving, cost-saving, simplicity of use, and other advantages of the present invention, which are goals only approached by the prior art, must be recognized as being a long-felt need, now fulfilled.

Accordingly, the various concepts and components are conceded and emphasized to have been widely known in the prior art as to various devices; nevertheless, the prior art not having had the particular combination of concepts and details as here presented and shown in novel combination different from the prior art and its suggestions, even only a fair amount of realistic humility, to avoid consideration of this invention improperly by hindsight, requires the concepts and achievements here to be realistically viewed as a novel combination, inventive in nature. And especially is this a realistic consideration when viewed from the position of a person of ordinary skill in this art at the time of this invention, and without trying to reconstruct this invention from the prior art without use of hindsight toward particulars not suggested by the prior art.

VII. BRIEF DESCRIPTION OF THE DRAWINGS

The above description of the novel and advantageous invention is of somewhat introductory and generalized form. More particular details, concepts, and features are set forth in the following and more detailed description of an illustrative embodiment, taken in conjunction with the accompanying Drawings, which are of somewhat schematic and diagrammatic nature for showing the inventive concepts; and in the Drawings:

FIG. 6 shows the module, in full lines in a fully collapsed condition, and in dashed lines the module's assembly of forelegs and mounting table in an intermediate stage of erection;

Figure 4:
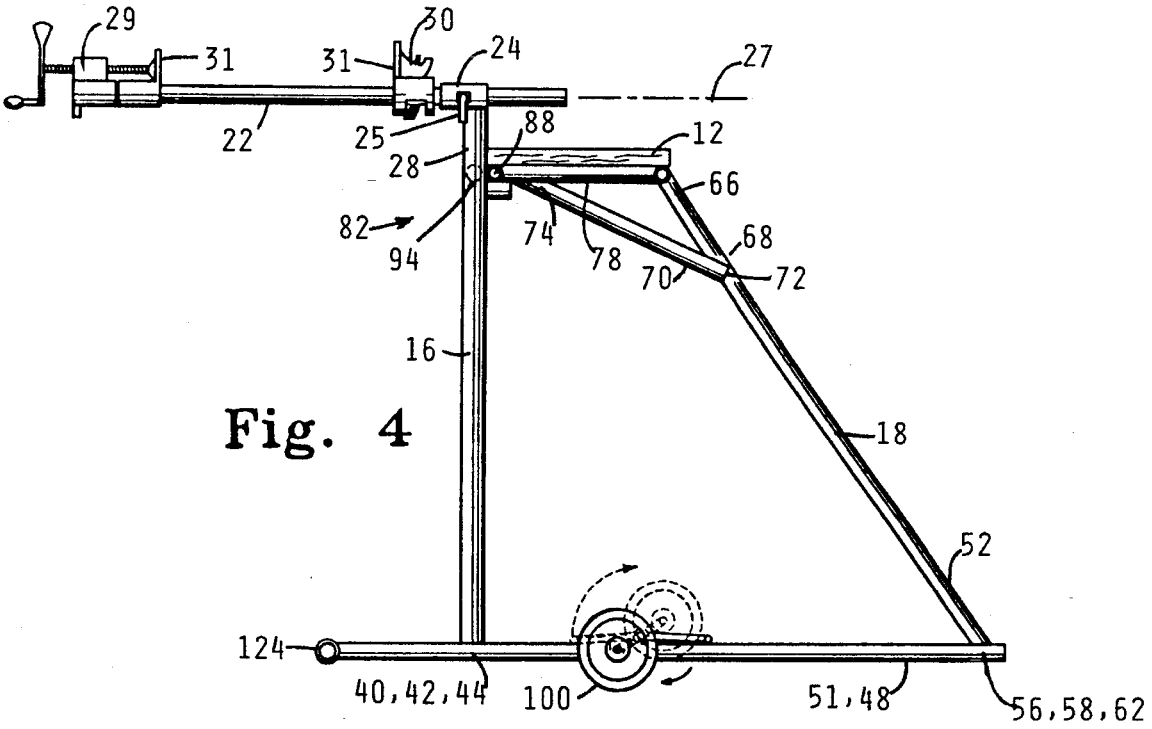
FIG. 4 is a side-elevational view of the module, erected, the full lines indicating the wheels in ground-engaging position, and the dashed lines showing the wheels in upraised condition.
Figure 7:
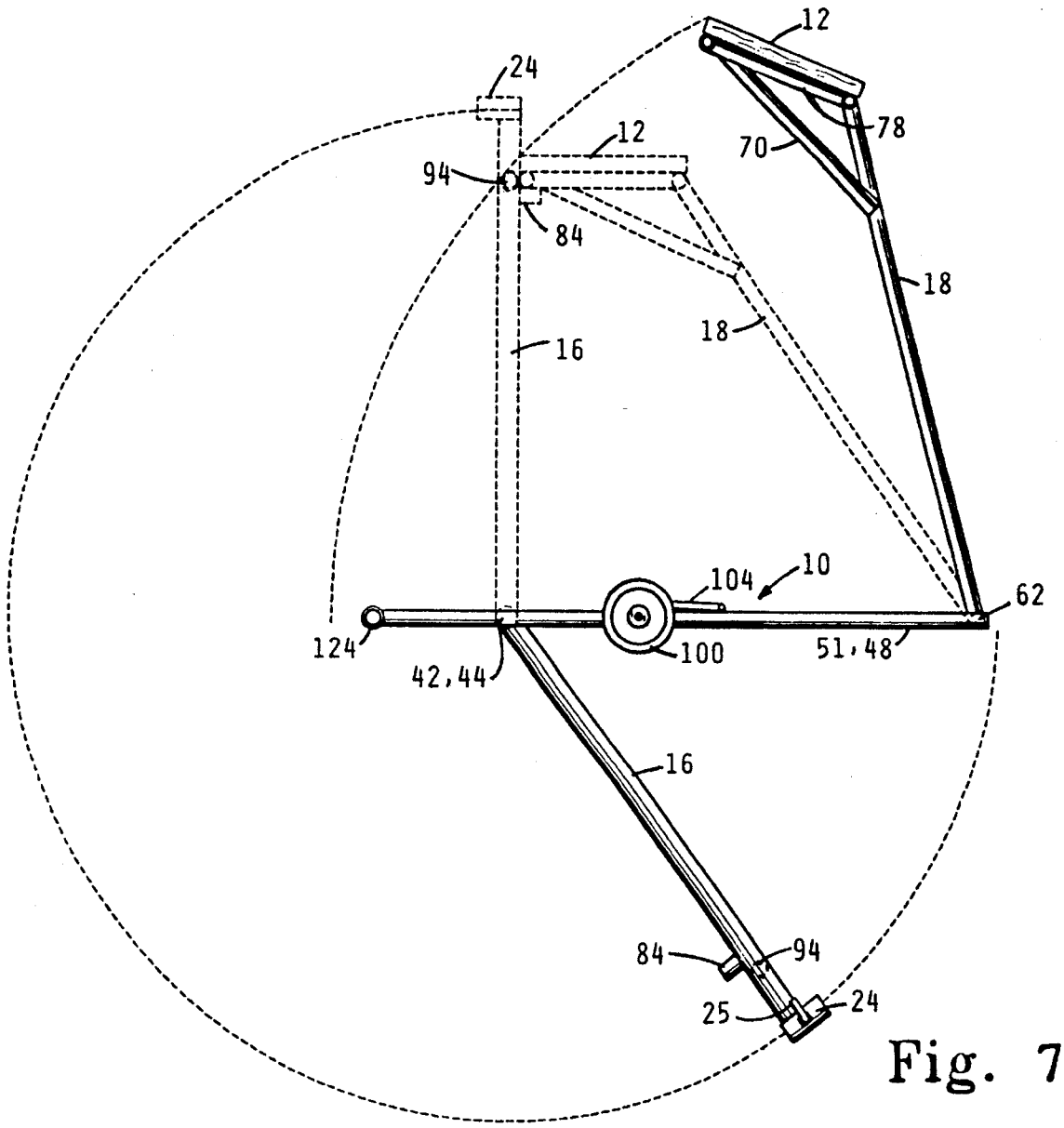
Figure 8:
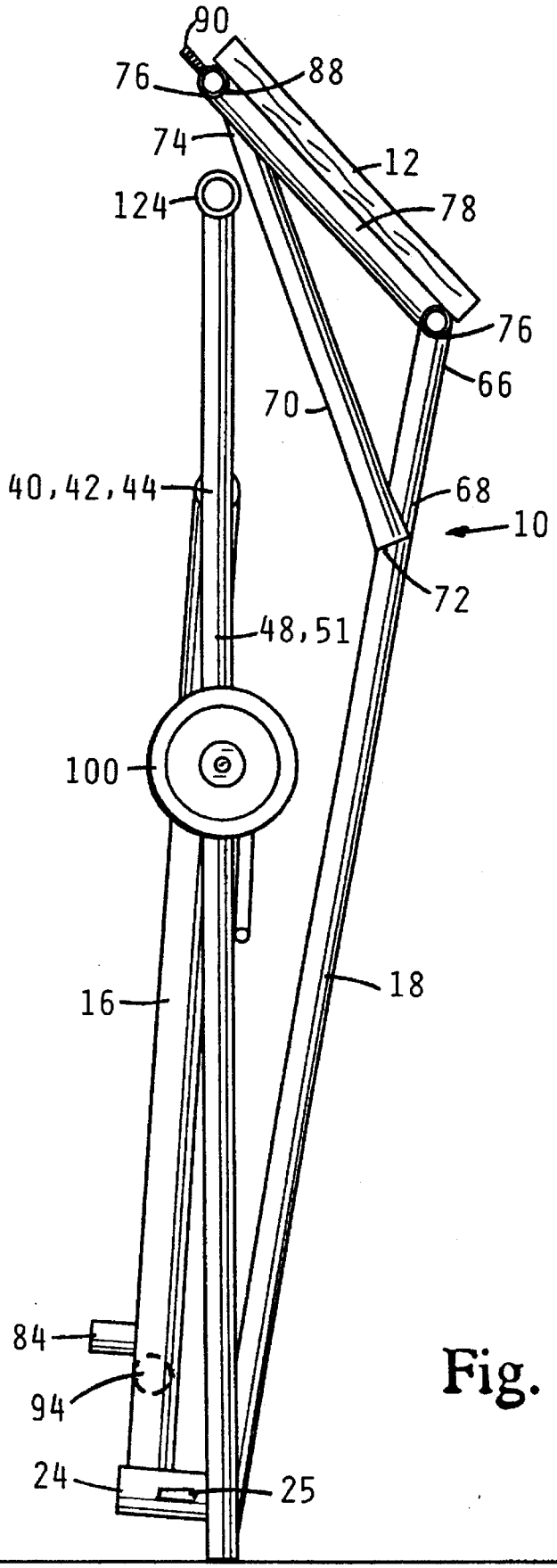

FIG. 7 is a view of the module, the full lines showing the assembly of forelegs and mounting table in an intermediate position of erection, and the assembly of rear legs and base in an intermediate position of erection, considering the base here in a horizontal position as used when the module is fully erect, and in dashed lines both the foreleg assembly and the rear leg assembly having been swung per the circular dashed lines in to a position of full erection of the module; and FIG. 8 is a somewhat enlarged elevational view of the module, in collapsed condition, wheels being shown in extended condition as in FIG. 4.

VIII. DETAILED DESCRIPTION OF ILLUSTRATIVE EMBODIMENTS

As shown in the Drawings, the overall module assembly 10 may perhaps be most easily understood as to concepts and construction details by reference primarily to FIGS. 1–5 and 8; for they show the assembly and components from various standpoints of understanding and viewing.

Figure 1:
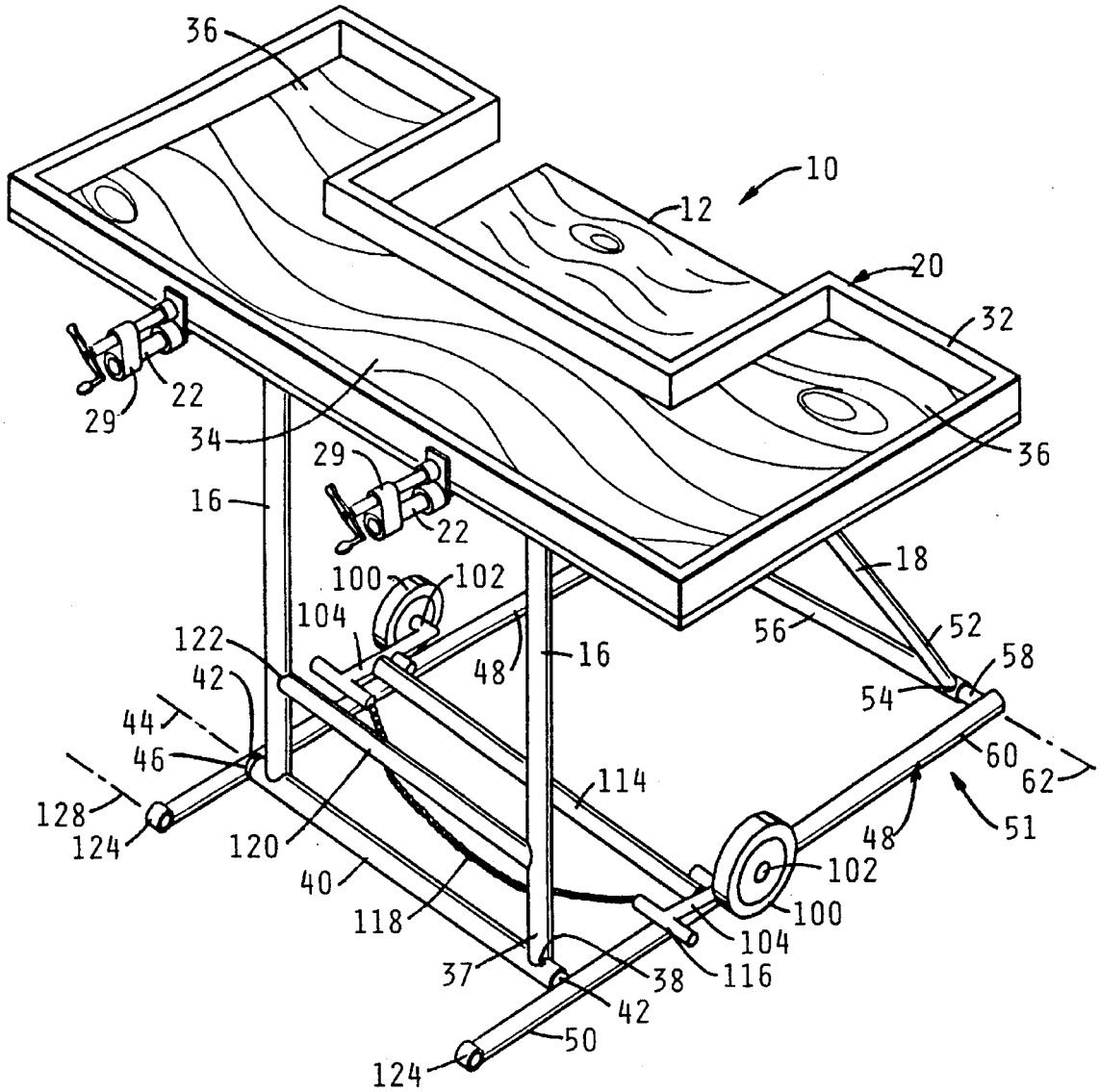
FIG. 1 is a pictorial view of a portable workstand module according to the concepts of the present invention, provided with a work table and a mounting table, as viewed from the rear and left side, as considered by an operator standing along a front side, i.e., adjacent the mounting table.

FIG. 1 pictorially shows the module assembly 10 as including a mounting plate 12 upon which may be mounted a vise 14 or other work tooling at a convenient elevation above the floor, that elevation being that of a pair of generally vertical rear legs 16 and a pair of sloping forelegs 18, those parts 12/16/18 being basic components of the module assembly 10, providing a very rigid support for the vise or other tool 14 even though the overall assembly is collapsable for ease of transport and/or storage, and has a minimum weight consistent with the necessity and strength for ruggedness of the assembly 10.

As to the rear legs 16, at the sides of the module 10 they are identical and they are rigidly interconnected (by transverse tubes 40, 94, and 120 described below), and they of course always move in unison; and thus to avoid apparent redundancy of reference numerals the welded unit of the two rear legs 16 is generally referred to herein as a rear leg assembly or leg-set 16.

As to the forelegs 18, at the sides of the module 10, similarly, they are identical and they are rigidly interconnected (by tube 56 and a transverse frame 78 described below) and they of course always move in unison; and thus to avoid apparent redundancy of reference numerals the welded unit of the two forelegs 18 is generally referred to herein as a foreleg assembly or leg-set 18.

A most obvious other although optional component is a panel-like work table 20 which is shown as supported (FIG. 3–5) by a pair of longitudinally extending and removable extender bars 22 which are releasably and slidably carried by the module 10 by insertion in a pair of nipples 24, each having an L-shaped screw-threaded clamping lever 25 (FIGS. 3–7) for fixing the bars 22 in the nipples 24, the nipples 24 shown as welded at 26, along fore-and-aft or longitudinal axes 27, to the top 28 of the rear leg 16 at each side of the module 10.

The extender bars 22 are shown as having a rearward clamp 29 and a forward clamp 30, each of the clamps 29/30 being movable on the extender bars 22 to provide for the secure but releasable gripping of the work table 20 or other object. Both clamps 29 and 30 have actuator mechanisms for releasably clamping the clamps at a selected position along the respective extender bar 22, and each of the clamps 29 and 30 has an upturned face 31 (FIGS. 2–5) for holding the work table 20 or other objects secure.

The work table 20 is shown as having peripheral walls 32 to minimize the chance of objects placed thereon from being accidently knocked off the work table 20; and the work table 20 with its walls 32 is shown as a general U-shape, having a rear portion 34 and forward side-portions 36, the side portions 36 extending generally alongside the sides of the mounting plate 12 for maximal convenience to the use of the mounting plate 12's characteristics of supporting the vise or other tool 14, although not extending so far forwardly as to interfere with the operativity of the vise or other tool 14 or the user's access to it.

The large work table 20, as an auxiliary article for miscellaneous workbench utility, illustrates the extra utility provided by the overall apparatus; and the provision of the carrying nipples 24 along opposed side edge portions of the mounting table 12 provides good stability for even a large article such as the work table 20.

The leg-sets 16 and 18 are supported in a stably spaced position on the module 10's base. That is, the rear leg-set 16 at their bottoms 37 are welded as at 38 to a rear transverse base tube 40, that base tube 40 shown as being a tube 40 revolvably assembled over a rear transverse bar 42 having axis 44, welded at 46 to, and transversely extending between, longitudinal base bars 48 near their rear end 50.

The two longitudinal base bars 48, together with the rear transverse support rod 42 and a similar brace bar (58) at the front of the module 10, provide a rectangular base 51 for the module 10. The base 51, comprising the base bars 48 at each side of the module 10, is usually referred to herein as a base frame or base frame assembly 48/51 (as described herein as including transverse rods 42, 58, and 114), as a welded base unit to which each of the leg sets 16 and 18 is rotatably connected.

The set of forelegs 18 is shown as having their bottoms 52 shown supported quite similarly to that of the bottoms 37 of the rear legs 16; more particularly, i.e., the foreleg 18's bottoms 52 are welded as at 54 to a tubular transverse front tube 56 which is rotatably assembled over a front transverse bar 58 extending inwardly from both sides adjacent the front end 60 of the bottom side bars 48, the front transverse bar 58, and thus of course the front tube 56, being on axis 62, and the weld of front transverse bar 58 to side ba 48 being indicated at 64, all as indicated in FIGS. 1–5.

The forelegs 18, near but spaced from their upper ends 66, FIGS. 4,8, and more particularly at an intermediate leg location 68, are provided with a short brace bar 70, the connection there of 68/70 being as by welds 72; and the upper ends 74 of the brace bars 70, and the upper ends 66 of the legs 18, are respectively connected as by welds 76 to a rectangular frame 78 which carries the mounting plate or table 12 such as by bolts 80 (FIG. 2) connecting the plate 12 and the rectangular frame 78, the assembly of the upper portion 66 of the forelegs 18, the brace bars 70, and the rectangular frame 78 with its mounting plate 12, being permanently connected by the welds 72 and 76 (FIG. 8).

As shown, the foreleg assembly 18 with its mounting plate 12 and brace bar 70 is an assembly which pivots about the forward transverse bottom axis 62, and the rearlegs set 16, with its supportive nipple 24 (with or without carrying the extender bars 22) pivot about the rearward transverse bottom axis 44; and this pivotal ability of the legsets 16/18 for collapsability is utilized along with a releasable connection of the legsets 16/18, the releasable connection thereof being at 82, adjacent the location of the upper end 28 of the rear leg set 16, as more fully described below.

Figure 5:
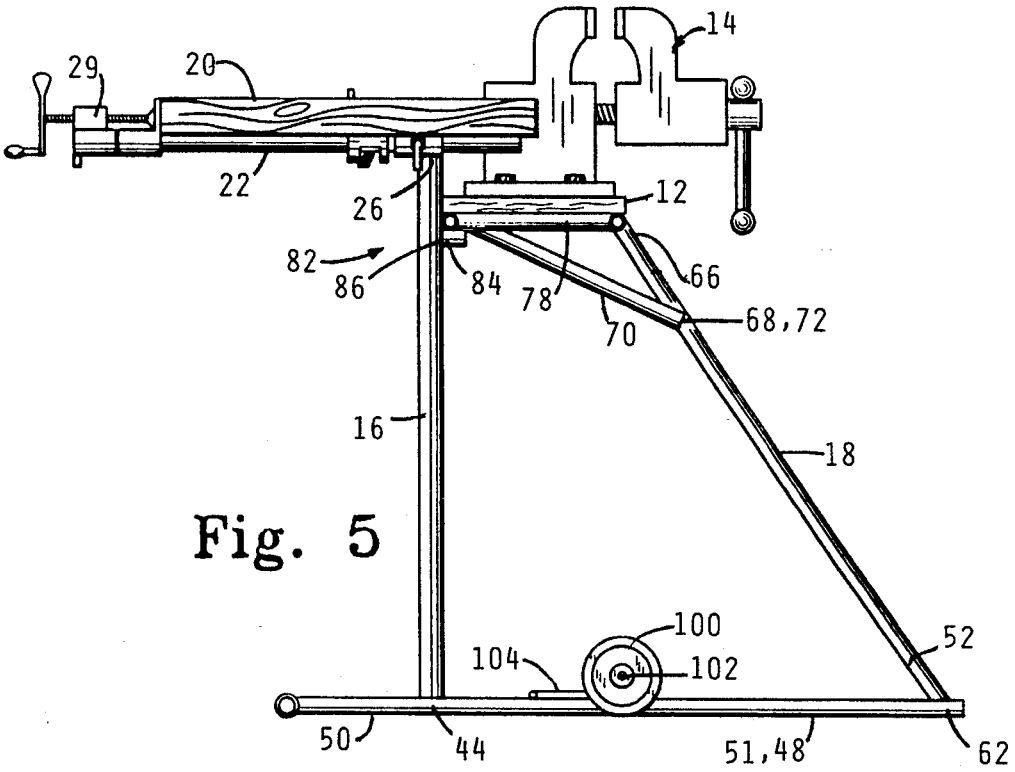
FIG. 5 is a side-elevation view similar to FIG. 4, with the wheels in an upraised position, and shown with a heavy duty vise mounted on the mounting table, and with a work table as in FIGS. 1 and 2.
Figure 6:
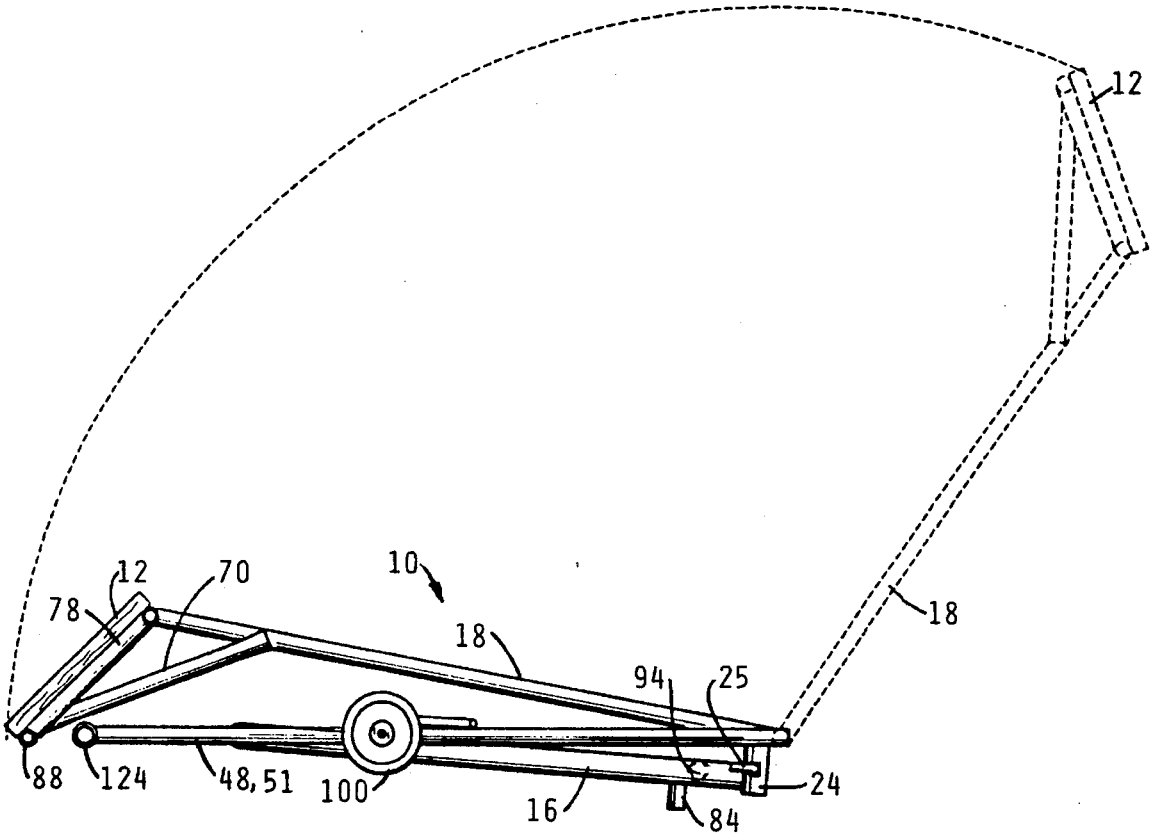
FIGS. 6, 7 and 8 are side-elevation views of the module in different stages of erection, and more particularly.

At the location 82, the upright support of leg assembly 18 by leg assembly 15 is by a short nipple 84 welded as at 86 to the vertical leg 16 at each side of the assembly 10. This support in the form shown is simply an unconnected support of the foreleg 18, i.e., that is by the nipple or lug 84 supporting the rearward transverse rod 88 of the rectangular frame 78, being an easy support-establishment when raising the module 10 from a collapsed condition (FIG. 8) to the upright position of FIGS. 1,4, and 5, i.e., giving temporary support so that the operator does not have to give much guidance alignment in making the erected condition of the assembly, the lugs 84 and bar 88 of frame 78 serving as the connection abutments. (FIGS. 4 and 5)

Figure 2:
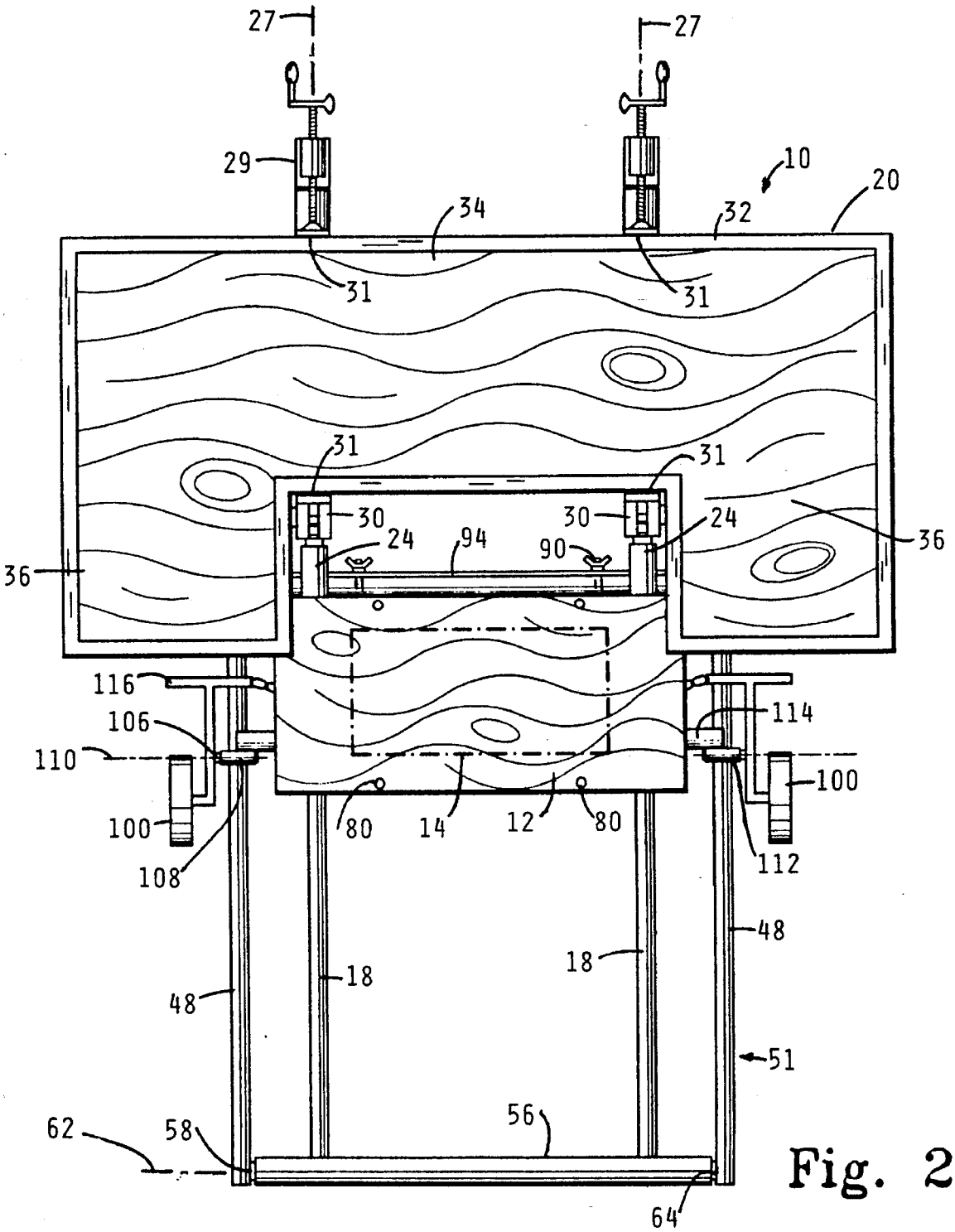
FIG. 2 is a plan view of the module shown in FIG. 1, with accessory equipment such as a vise schematically shown by chain lines as mounted on the mounting table shown in FIG. 1.
Figure 3:
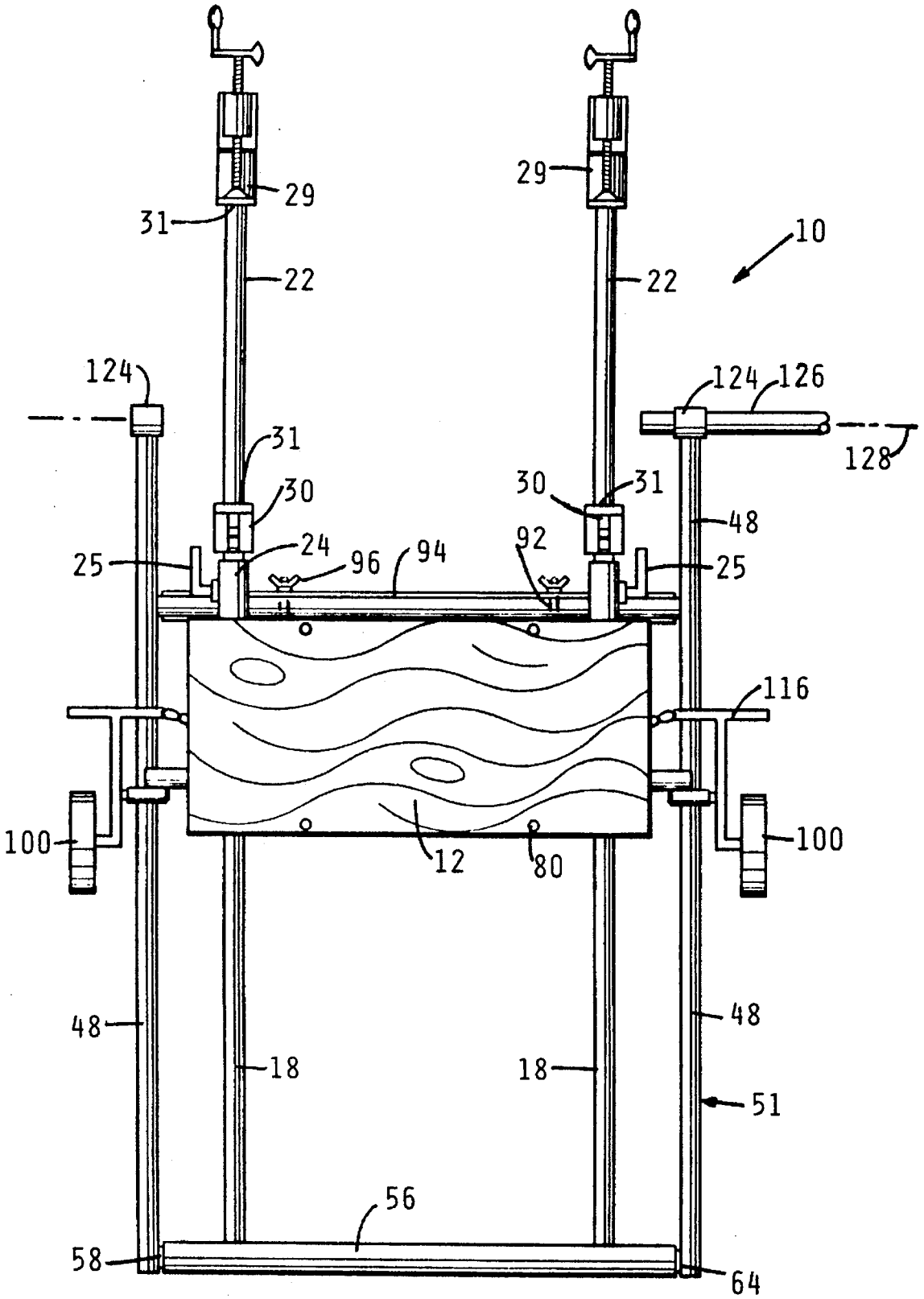
FIG. 3 is a plan view of the module as shown in FIGS. 1 and 2 but with the work table removed.

A positive locked position of leg sets 16/18 is provided, however, by the provision of a bolt 90 which passes through a horizontal opening(not shown) in the above-mentioned rear tube 88 of the frame 78, and passing outwardly, rearwardly, through a horizontal hole (schematically shown as 92 in FIG. 3), which hole 92 is provided in an upper transverse support bar 94 which is welded to the upright legs 16. (The bar 94 is shown in FIGS. 2 and 3, but only in dash lines in FIG. 4 because in FIG. 4 and 5 i is behind the upright leg member 16.)

A wing nut 96 is provided for each bolt 90, so when (FIG. 4) the operator has swung the leg-assemblies 16/18 to the erect condition (FIGS. 4 and 5) and inserted the bolt 90 through the opening in the rear tube 88 of frame 78 and through hole 92 in support bar 94, the wing nut 96 on bolt 90 maintains the erect module condition, with the welded lug abutment 84 sustaining most of any vertical load occurring due to the heavy vise 14 on the mounting plate 12 or use of the vise, etc.

In addition to the collapsability for convenience of transport and storage, as further detailed herein, the apparatus 10 provides both the stability of non-wheeled floor-engagement, as well as a transport portability of wheels for roller movement ease.

That is, wheels 100 are shown as mounted in a special manner on the longitudinal floor pieces 48, as is probably easiest seen in connection with the rightward wheel 100, it being the leftward of the wheels 100 as illustrated in FIG. 1.

More particularly, as to each of the wheels 100, the wheel 100 is carried on a transverse axle having an axis 102, which axle 102 is carried by lever 104 which has a transverse fulcrum piece 106 (FIGS. 2 and 3) supported in a short nipple 108, the nipple 108 extending transversely on axis 110 and welded at 112 to the longitudinal lower support bar 48 and to an end of a transverse support bar 114.

Further as to the wheels 100, their support levers 104 are each provide at their rear with a handle 116; and those handles 116 at both sides of the apparatus are interconnected by a chain 118, the chain 118 providing a means by which the user can manipulate both of the wheel levers 104 by a single manual motion in achieving their movement between a lowered (FIG. 4) portability condition of wheels 100 and upraised stability (FIG. 5) condition in which the longitudinal support bars 48 directly engage the floor for achieving the direct-support stability unfettered by any engagement of the floor by the wheels 100.

The transverse lower support bar 114, being at a location substantially rearwardly of the front support tube 56, provides a desirable step-on bar to assure against inadvertent movement of the assembly 10, when using the vise 14 or other use of the module 10.

The rear legs 16 are shown as interconnected near their bottoms, a few inches above the lower support bar 40, by a transverse support bar 120 welded as by welds 122 to each of the respective legs 16.

Further stability is optionally achieved by each of the longitudinal bottom support legs 48 being provided at the rear end 50 with a short nipple 124, through the bore of which nipple 124 may be inserted a stabilizer leg 126. The axis 128 of the nipples 124 being transverse of the assembly 10, the stabilizer bars 126 provide great lateral stability for the module 10 in a heavy duty use.

IX. ASSEMBLY FROM COLLAPSED STATE

As to erection or assembly of the module 10, as from its fully collapsed state of FIG. 8 to its fully work-ready condition of FIG. 1, assume that the user is standing behind the module 10 with the module 10 in the condition or orientation as it shows in FIG. 8, i.e., the user is facing the module 10 from its rear side and is facing the reader, from behind the plane of the paper on which FIG. 8 is printed.

From behind the plane of the paper of FIG. 8 while facing the reader, the user will steady the assembly 10 by using his left hand to grasp the rear surface of the mounting plate 12 and the rear bar 88 of the rectangular frame 78, and grasp the transverse rod 94 of the rear leg assembly 16 with his right hand, of course bending to the extent necessary, for although the transverse bar 94 ultimately is in the high position indicated for it in FIG. 4, bar 94 is in a very low position in the FIG. 8 collapsed stage.

Then the user will swing the leg assembly 16, by force on transverse bar 94, from the leg assembly 16's vertical position of FIG. 8, about 90° to a generally horizontal position, that rotational swinging being of course rotationally about axis 44.

The user then pulls transverse bar 94 farther outwardly and upwardly, far enough to draw the base frame 48/51 away from the front leg assembly 18 until the base frame assembly 48/51 is in effect co-planar with rear leg assembly 16, at which condition or location the weight of the bottom frame assembly 48/51 and the weight of the rear leg assembly 16 causes a continuation of the rotational movement of the bottom frame assembly 48/51 until the base frame assembly is horizontal, resting on the ground (as in FIG. 5 or resting on the wheels 100 as in FIG. 4, depending upon the setting of the wheels 100 by their handles 116 and/or the use of a chain 118).

At this time the rear leg assembly 16 will now have assumed a substantially vertical position as shown in the erect condition of the module 10 shown in FIG. 1.

Then with the user's left hand, he will start the front leg assembly 18 to rotate rearwardly, here leftwardly, about axis 62, the relatively few degrees until the rear bar 88 of the mounting plate 12's frame 78 comes to a rest on the rear legs 16s' abutment lugs 84.

The erect condition of all of FIGS. 1–6 is now supportively although merely temporarily established, the weight of the vise 14 and the front leg assembly 18 being supported by the lug 84.

Achieving the desired locked position of the leg frames 16/18, the user guides the bolts 90 through their respective holes 92 of bar 94, then applying the wing nuts 96.

Lastly, the user will make any adjustment of the wheels 100 as desired, noting FIGS. 4 and 5 and the description already given.

The user will add stabilizer bars 126 in base nipples 124 and extender bars 22 in the rear leg frame nipples 24, together with the mounting on the mounting plate 12 of whatever vise 14 or other equipment is desired. The work table 20 is added, being supported on the extender bars 22, and clamped by clamps 29/30.

X. DISASSEMBLY

To disassemble, take off the work table 20, extender bars 22, and stabilizer bars 126; and take the wing nuts 96 off the bolts 90, and pull the leg assemblies 16/18 apart by raising the front leg assembly 18 upwardly and rightwardly (as appears in FIG. 7, although leftwardly as viewed by a user facing the reader) by having the user's right hand on bar 94 and his left hand on rear bar 88 of the rectangular frame 78 of the mounting table 12.

Then the user with his right hand raises tube 94 so that the base frame assembly 48/51 gets up to about 60°, at which time the operator can use his right knee to push the base assembly 48/51 into the fully collapsed position nested against the vertically held front leg assembly 18. The rear leg assembly 16 is then lowered about axis 44, downward, while being held by tube 94 into a vertical position nested atainst base frame assembly 48/51.

Alternatively, after the leg assemblies 16/18 are pulled apart, the right hand lowers the rear leg assembly 16 by rotating rightwardly (as views by the user facing the reader) until the rear leg assembly 16 is lying flat on ground. The user's right hand then grasps tube 40, while his left hand is still holding the front leg assembly 18 vertical; and with an upward motion he raises the rear leg assembly 16, about axis 44, and with a leftwardly motion he nests both base assembly 48/51 and rear leg assembly 16 against front leg assembly 18, as in FIG. 8.

XI. SUMMARY OF THE ADVANTAGES

The present invention as detailed herein has advantages in both concept and in component parts and features; for in contrast to other articles known to the inventor as to the prior art mentioned, the invention provides advantageous features which should be considered, both as to their individual benefit, and to whatever may be considered to be also their synergistic benefit toward the invention as a whole. Such features include:

(a) Easy to use, with advantages of both ruggedness and mobility;

(b) Use is easy to learn;

(c) Economical of formation;

(d) Provides convenience of mobility without inherent disadvantages of heavy and sturdy embodiments;

(e) Provides various supporting tasks as to various types of work objects; and (f) Allows modification and/or add-ons as may be desired, although the illustrative embodiment provides a variety of work-support features.

XII. CONCLUSION AS TO INVENTIVE COMBINATION

It is thus seen that a combination type apparatus and support assembly constructed and used according to the combination of inventive concepts and details herein set forth, provides novel concepts of a desirable and usefully advantageous article and procedure, yielding advantages which are and provide special and particular advantages when used as herein set forth.

In summary as to the nature of the overall invention's advantageous concepts, their novelty and inventive nature is shown by novel features of concept and construction shown here in advantageous combination and by the novel concepts hereof not only being different from all the prior art known, even though other workbench types have been known and used for scores of years, but because the achievement is not what is or has been suggested to those of ordinary skill in the art, especially realistically considering this as a novel combination comprising components which individually are similar in nature to what is well known to most all persons, surely including most of the many makers and users of workbenches for a great number of years, throughout the entire world. No prior art component or element has even suggested the modifications of any other prior art to achieve the particulars of the novel concepts of the overall combination here achieved, with the special advantages which the overall combination article provides; and this lack of suggestion by any prior art has been in spite of the long worldwide use of various types of workbenches and mobile apparatus.

The differences of concept and construction as specified herein yield advantages over the prior art; and the lack of this invention by the prior art, as a prior art combination, has been in spite of this invention's apparent simplicity of the construction once the concepts have been conceived, in spite of the advantages it would have given, and in spite of the availability of all the materials, to all persons of the entire world, and the invention's non-technical and openly-visible nature.

Quite certainly this particular combination of prior art details as here presented in this overall combination has not been suggested by the prior art, this achievement in its particular details and utility being a substantial and advantageous departure from prior art, even though the prior art has had similar components for numbers of years. And particularly is the overall difference from the prior art significant when the non-obviousness is viewed by a consideration of the subject matter of this overall device as a whole, as a combination integrally incorporating features different in their combination from the prior art, in contrast to merely separate details themselves, and further in view of the prior art not achieving particular advantages here achieved by this combination.

Accordingly, it will thus be seen from the foregoing description of the invention according to this illustrative embodiment, considered with the accompanying drawings that the present invention provides new and useful concepts of a novel and advantageous article and procedure, possessing and yielding desired advantages and characteristics in formation and use, and accomplishing the intended objects, including those hereinbefore pointed out and others which are inherent in the invention.

Modifications and variations may be effected without departing from the scope of the novel concepts of the invention; accordingly, the invention is not limited to the specific ambodiment or form or arrangement of parts herein described or shown.

Thus, e.g., although welding is desirable for connections (except, of course, temporary connections such as bolts 90 and nuts 96) to avoid redundancy other possible connections are not specified. Also, e.g., to avoid redundancy, the legs and other supports (other than tubes 40 and 56 which are specified tubular as being rotational connection members, and nipples) are referred to herein usually just by the general term "bars" although preferably the advantage of weight minimization means that tubular construction is used maximally.

Also, e.g., although the immediate support for the vise 14 is illustrated in the Drawings and in the text by a rectangular table slab supported by a rectangular frame 78, the term "mounting table" is used in the general sense of any supportive stand or suitable mounting for a heavy tool such as a heavy-duty vise 14.

What is claimed is:

1. A workstand module comprising:

a mounting table, sets of leg means supporting the mounting table at an elevation above the supporting floor, and a pair of extenders releasably connectable respectively to opposed edge portions of the mounting table, the extenders providing support for an auxiliary article carried adjacent the mounting table, in which the sets of leg means include a set of front leg means and a set of rear leg means, and a set of base means to which both sets of leg means are supportively connected, and which maintain a stably-spaced position of the set of front leg means and the set of rear leg means, in which the set of front leg means and the set of rear leg means are rotationally connected to respective portions of the base means, and rotational movement of the set of front leg means and of the set of rear leg means, with respect to the base means, provides optionally a module-erect and a module-collapsed condition of the module, in a combination in which upper portions of the set of front leg means and the set of rear leg means are provided respectively with cooperating abutment means which are engageable, merely by rotation of those sets of leg means from module-collapsed position toward module-erect position, to provide connection means for releasably interconnecting upper portions of the set of front leg means and the set of rear leg means in the module-erect condition of the module.

2. A workstand module as set forth in claim 1, in a combination in which releasable connection means are provided for releasably interconnecting upper portions of the set of front leg means and the set of rear leg means.

3. A workstand module comprising:

a mounting table, sets of leg means supporting the mounting table at an elevation above the supporting floor, and a pair of extenders releasably connectable respectively to opposed edge portions of the mounting table, the extenders providing support for an auxiliary article carried adjacent the mounting table, in which the sets of leg means include a set of front leg means and a set of rear leg means, and a set of base means to which both sets of leg means are supportively connected, and which maintain a stably-spaced position of the set of front leg means and the set of rear leg means, in which the base means is provided with wheel means, and the wheel means are provided with control means which are manually actuable to cause the wheel means to extend below the base means or not below the base means at the option of the user, thus to optionally provide a rolling movability and a non-rolling fixedness for the module, in a combination in which there is a wheel means at each side of the module, and the control means is operable by a single manual motion to cause the wheel means at both sides of the module to move to the user-option position.

4. A workstand module comprising:

a mounting table, sets of leg means supporting the mounting table at an elevation above the supporting floor, the leg means including a set of front leg means, and a set of rear leg means, and a set of base means to which both sets of leg means are supportively connected, and which maintain a stably-spaced position of the set of front leg means and the set of rear leg means, which the base means is provided with wheel means, and the wheel means are provided with control means which are manually actuable to cause the wheel means to extend below the base means or not below the base means at the option of the user, thus to optionally provide a rolling movability and a non-rolling fixedness for the module, in a combination in which there is a wheel means at each side of the module, and the control means is operable by a single manual motion to cause the wheel means at both sides of the module to move to the user-option position.

* * * * *

UNITED STATES PATENT AND TRADEMARK OFFICE

CERTIFICATE OF CORRECTION

PATENT NO. : 5,603,491

DATED : Feb. 18, 1997

INVENTOR(S) : Anthony S. Murrell

It is certified that error appears in the above-identified patent and that said Letters Patent is hereby corrected as shown below:

Col. 1, Line 4; after "workstand" delete the comma.

Col. 4, Line 6; Change "he" to: -- the --.

Col. 4, Line 19; After "approach" insert: -- to --.

Col. 7, Line 17; Before "is by" change "15" to: -- 16 --.

Col. 7, Line 66; Change "provide" to: -- provided --.

Col. 12, Line 44; Before "which" insert: -- in --.

Signed and Sealed this

Sixth Day of May, 1997

Bruce Lehman

*Attest:*

BRUCE LEHMAN

*Attesting Officer*

*Commissioner of Patents and Trademarks*